US008616192B2

(12) United States Patent
Vets

(10) Patent No.: US 8,616,192 B2
(45) Date of Patent: Dec. 31, 2013

(54) ROUND BRILLIANT CUT GEMSTONE AND METHOD FOR CUTTING THE SAME

(76) Inventor: Alain Vets, Booischot (BE)

( * ) Notice: Subject to any disclaimer, the term of this patent is extended or adjusted under 35 U.S.C. 154(b) by 51 days.

(21) Appl. No.: 12/961,139

(22) Filed: Dec. 6, 2010

(65) Prior Publication Data

US 2011/0146350 A1 Jun. 23, 2011

Related U.S. Application Data

(60) Provisional application No. 61/285,626, filed on Dec. 11, 2009.

(51) Int. Cl.
*B28D 5/00* (2006.01)

(52) U.S. Cl.
USPC ..... 125/30.01; 63/32

(58) Field of Classification Search
USPC ..... 125/30.01, 39; 63/26, 32, 33; D11/89, D11/90
See application file for complete search history.

(56) References Cited

U.S. PATENT DOCUMENTS

| | | | | |
|---|---|---|---|---|
| 2,364,031 | A | 11/1944 | Suderov | |
| 4,306,427 | A | 12/1981 | Urban | |
| D460,711 | S | 7/2002 | Cohen | |
| D503,354 | S | 3/2005 | So | |
| 6,990,833 | B2 * | 1/2006 | Smith | 63/32 |
| D526,593 | S | 8/2006 | Zaicik | |
| D528,459 | S | 9/2006 | Zaicik | |
| D529,836 | S | 10/2006 | Sanghvi | |
| D530,642 | S | 10/2006 | Botha | |
| D547,691 | S | 7/2007 | Hodara et al. | |
| 7,249,471 | B2 * | 7/2007 | Kawabuchi et al. | 63/33 |
| D550,118 | S | 9/2007 | Botha | |
| D555,032 | S | 11/2007 | So | |
| D632,205 | S | 2/2011 | Mehta | |
| 7,878,025 | B2 * | 2/2011 | Rydlewicz | 63/26 |
| 8,156,760 | B2 | 4/2012 | Gad | |
| 2005/0011226 | A1 | 1/2005 | So | |
| 2006/0037360 | A1 | 2/2006 | So | |
| 2006/0086143 | A1 * | 4/2006 | Biro | 63/32 |
| 2006/0137674 | A1 | 6/2006 | Aoyagi | |
| 2009/0038341 | A1 * | 2/2009 | Zheng | 63/32 |
| 2009/0308104 | A1 | 12/2009 | Gad | |
| 2010/0154473 | A1 * | 6/2010 | Xheng | 63/32 |

OTHER PUBLICATIONS

Extend European search report dated Jun. 13, 2012 in European Patent Application No. 10015134.9.

* cited by examiner

*Primary Examiner* — Eileen P. Morgan
(74) *Attorney, Agent, or Firm* — Lewis Roca Rothgerber LLP

(57) ABSTRACT

The invention relates to a gemstone (10) comprises a girdle (13), a crown (11) and a pavilion (12). The crown (11) comprises a table (14), eight star facets (15) surrounding the table (14), eight first half facets (16) aligned between the star facets (15), eight second half facets (17) aligned adjacent to the first half facets (16) and sixteen upper girdle facets (20) aligned between the second half facets (17). The pavilion (12) comprises sixteen pavilion main facets (23) and sixteen lower girdle facets (25) aligned between the pavilion main facets (23). The invention also relates to a method of cutting the gemstone.

10 Claims, 3 Drawing Sheets

ROUND BRILLIANT CUT GEMSTONE AND METHOD FOR CUTTING THE SAME

CROSS-REFERENCE TO RELATED APPLICATIONS

This application claims priority to co-pending U.S. Provisional Patent Application Ser. No. 61/285,626, filed Dec. 11, 2009, the entirety of which is incorporated by reference herein.

FIELD OF THE INVENTION

The present invention relates to gemstone and more particularly, to a round brilliant cut gemstone and method for cutting the same.

BACKGROUND OF THE INVENTION

The round brilliant cut is the most popular cut shape for diamonds. Diamonds have various characteristics and three of the main characteristics are brilliance, dispersion and scintillation.

Brilliance is an essential attribute of a diamond and it generally refers to the amount of light that impinges on the top of the diamond and reflects back. Bright diamonds return lots of light from the surroundings back to an observer.

Dispersion, which is also known as fire, refers to the prism of light refracted from within a cut diamond and relates to the rainbow colours that are emitted from the gemstone as it is viewed from different angles when a diamond moves relative to an observer.

Scintillation is the intense sparkles in a diamond as the diamond moves.

The light performance of a diamond is impacted by, among other things, the number, shape, angles and arrangement of facets on the cut diamond. A slight variation in one factor can alter the brilliance and appearance of the diamond.

There are a variety of brilliant gemstone cuts available on the market. A conventional round brilliant cut diamond consists of 57 facets, or 58 facets including a culet. However, even with this number of facets, a conventional round brilliant cut diamond does not address a specific need of a particular way of having a gemstone cut that exhibits excellent brilliancy, scintillation and dispersion.

There is therefore a need for a new gemstone cut and corresponding method for cutting a gemstone which uniquely maximizes and balances the features of brilliance, scintillation and dispersion of gemstones.

SUMMARY OF INVENTION

It is the object of the present invention to provide a gemstone with enhanced characteristics of brilliance, scintillation and dispersion over the prior art or to at least provide the public with a useful choice.

It is also an object of the present invention to provide a method for cutting a gemstone with enhanced characteristics of brilliance, scintillation and dispersion over the prior art or at least provides the public with a useful choice.

According to one aspect of the invention, a gemstone is provided, comprising a girdle, a crown extending in a first direction from the girdle, and a pavilion extending in a second direction from the girdle, opposite the first direction. The crown comprises a table, eight star facets surrounding the table, eight first half facets aligned between the star facets, eight second half facets provided adjacent to the first half facets and sixteen upper girdle facets with each of the upper girdle facets provided adjacent to, and forming a common edge with another upper girdle facet to form a pair of upper girdle facets. Each pair of the upper girdle facets is aligned between two adjacent second half facets. The pavilion comprises sixteen pavilion main facets extending concentrically from a point of the pavilion distant from the girdle and sixteen lower girdle facets aligned between the pavilion main facets, and wherein the first half facets and the second half facets are formed at different angles.

Preferably, the eight first half facets are each formed at an angle between 32.0° and 35.0° relative to a plane parallel to horizontal plane of the girdle.

Preferably, the eight second half facets are each formed at an angle between 35.0° and 38.0° relative to a plane parallel to horizontal plane of the girdle.

Preferably, the star facets and the first half facets form a first portion of the crown and the second half facets and the upper girdle facets form a second portion of the crown.

Preferably, the first portion of the crown is inclined at an angle smaller than that of the second portion of the crown.

Preferably, the star facets are formed at an angle between 19.0° and 22.0° and the upper girdle facets are formed at an angle between 40.0° and 43.0° relative to a plane parallel to horizontal plane of the girdle.

According to another aspect of the invention, a method of cutting a gemstone having a crown, a girdle and a pavilion is provided, the method comprising forming eight second half facets on the crown, forming eight first half facets adjacent to the second half facets, forming a table on the crown, forming eight star facets surrounding the table and aligning each of the star facets between two adjacent first half facets, forming sixteen upper girdle facets, each of the upper girdle facets provided adjacent to, and forming a common edge with another upper girdle facet to form a pair of upper girdle facets and aligning each pair of the upper girdle facets between two adjacent second half facets, forming sixteen pavilion main facets on the pavilion, each of the pavilion main facets extending concentrically from a point of the pavilion distant from the girdle, forming sixteen lower girdle facets and aligning each of the lower girdle facets between two adjacent pavilion main facets, and wherein the first half facets and the second half facets are formed at different angles.

BRIEF DESCRIPTION OF DRAWINGS

For the purposes of illustrating the invention, there is shown in the drawings a form which is presently preferred. It is being understood however that this invention is not limited to the precise arrangements shown.

DETAILED DESCRIPTION OF THE INVENTION

Figure 1:
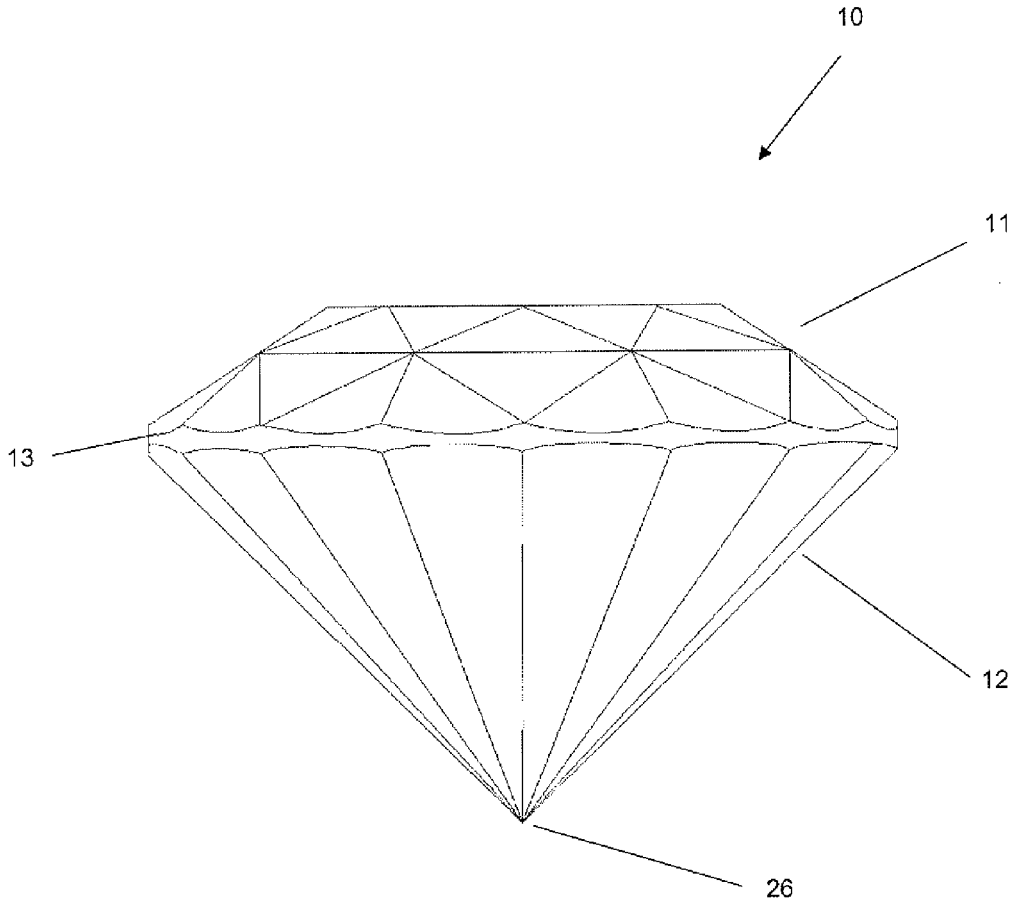
FIG. 1 is a side elevational view of a gemstone according to the present invention.

Referring now to the drawings, preferred embodiments of the present invention are described more particularly.

FIG. 1 is a side elevational view of a circular cut gemstone 10 according to the present invention. As shown in FIG. 1, the gemstone 10 includes a top or crown 11, a base or pavilion 12, and a girdle 13 provided on the lateral surface along the boundary of the crown 11 and the pavilion 12 as shown in FIG. 1.

Figure 2:
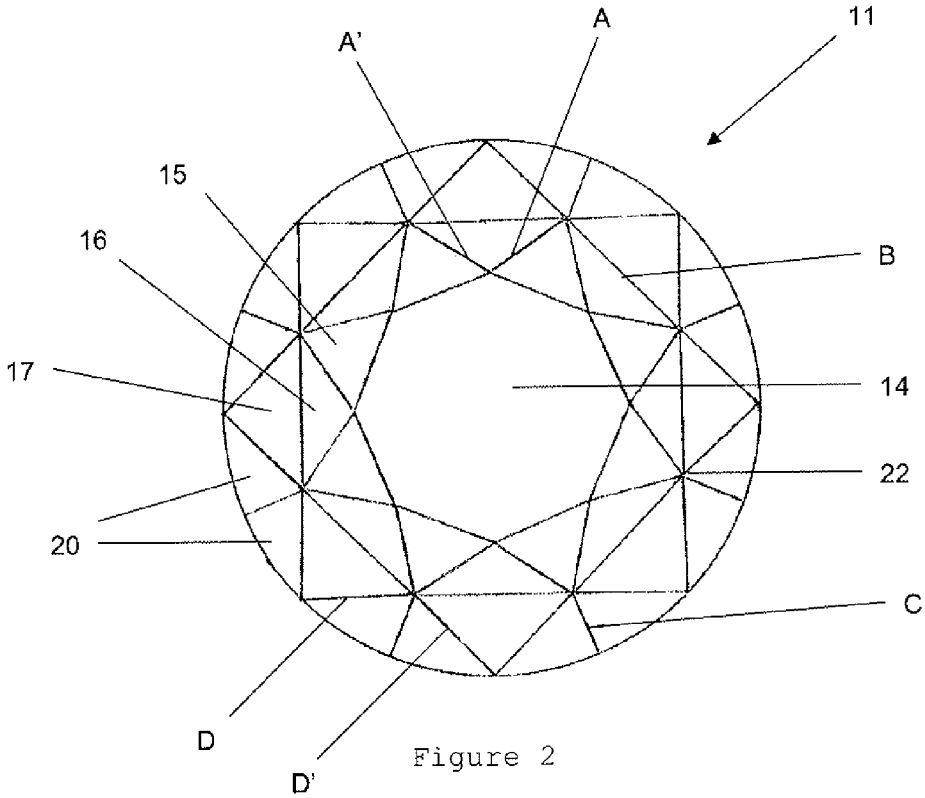
FIG. 2 is a top view of the gemstone shown in FIG. 1.

FIG. 2 is a top view showing the crown 11 of the gemstone 10 of FIG. 1. As shown in FIG. 2, the crown 11 includes a table 14 and eight substantially equally-spaced triangular facets known as star facets 15. The star facets 15 are aligned immediately surrounding the table 14 and adjacent to the table 14. Each of the star facets 15 is substantially identical in size and is formed at an angle between 19.0° and 22.0° relative to a plane parallel to a horizontal plane of the girdle 13.

The crown 11 further includes eight first half facets 16 and eight second half facets 17. Each of the first half facets 16 and each of the second half facets 17 are substantially triangular, having a first side, a second side and a base.

Each of the first half facets 16 is aligned between two adjacent star facets 15 such that the first side of the first half facet forms a common edge A with a side of a first star facet and the second side of the first half facet forms a common edge A' with a side of a second star facet that is positioned adjacent to the first star facet. The first half facets 16 are formed at an angle between 32.0° and 35.0° relative to the plane parallel to the horizontal plane of the girdle 13.

Each of the second half facets 17 is provided adjacent to, and forms a common edge B with the base of each respective first half facet 16. The second half facets 17 are formed at an angle between 35.0° and 38.0° and preferably, between 35.0° and 37.0° relative to the plane parallel to the horizontal plane of the girdle 13.

The crown 11 further includes sixteen upper girdle facets 20 provided around the periphery of the crown 11. In one embodiment of the invention, each of the upper girdle facets 20 has a first side, a second side and a substantially curved side forming part of the circumference of the girdle 13. Each of the upper girdle facets 20 is provided adjacent to, and forms a common edge C with another upper girdle facet to form a pair of upper girdle facets. Each pair of the upper girdle facets 20 is provided between two adjacent second half facets 17 such that one side of the pair of upper girdle facets forms a common edge D with a side of a first second half facet and an opposite side of the pair of upper girdle facets forms a common edge D' with a side of a second second half facet that is positioned adjacent to the first second half facet. The upper girdle facets 20 are formed at an angle between 40.0° and 43.0° relative to the plane parallel to the horizontal plane of the girdle 13.

Each pair of the upper girdle facets 20, together with two adjacent second half facets 17, two adjacent first half facets 16 and one star facet 15, are aligned in a manner such that they form a point 22 where all the seven common facets meet.

In one embodiment of the invention, the star facets 15 and the first half facets 16 form an upper portion of the crown 11, and the second half facets 17 and the upper girdle facets 20 form a lower portion of the crown 11. In the preferred form, the upper portion of the crown 11 is inclined at an angle smaller than that of the lower portion of the crown 11. In another preferred form, the upper portion of the crown 11 has a height of 50% relative to the total height of the crown 11.

Figure 3:
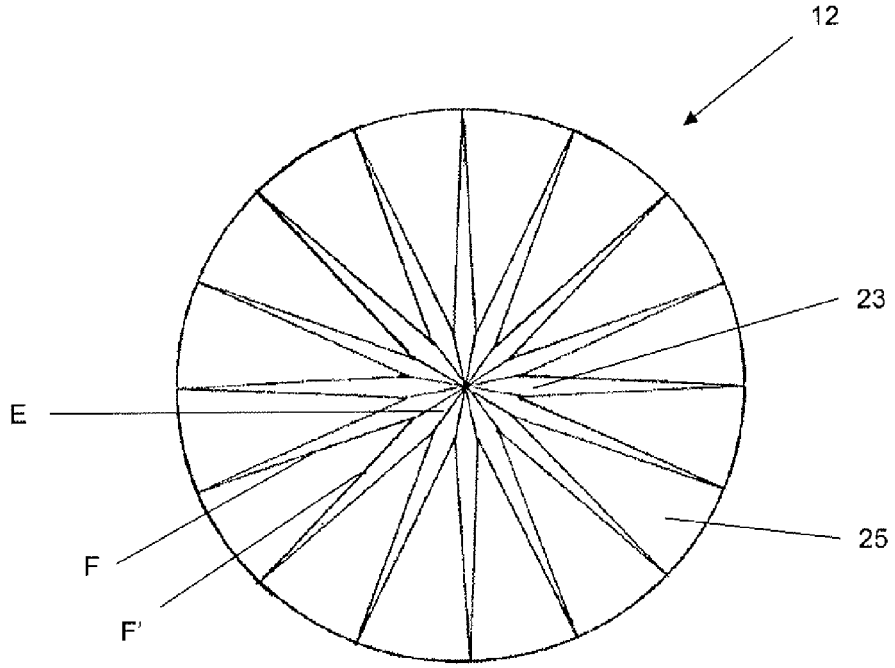
FIG. 3 is a bottom view of the gemstone of FIG. 1.

FIG. 3 is a bottom view showing the pavilion 12 of the gemstone 10 of FIG. 1. As shown in FIG. 3, the pavilion 12 includes sixteen concentrically substantially equally spaced pavilion main facets 23 extending from a point of the pavilion 12 distant from the girdle, to the girdle 13. Each of the pavilion main facets 23 has four sides, two of which form a first portion of the pavilion main facet 23 and the other two form a second portion of the pavilion main facet 23, opposite the first portion. Each side of the first portion of the pavilion main facet is immediately adjacent to, and forms a common edge E with a side of the first portion of another pavilion main facet. In the preferred form, the first portion of each of the pavilion main facets 23 is shorter than the second portion of the same pavilion main facet.

Between the pavilion main facets 23 are sixteen substantially triangular lower girdle facets 25 provided around the periphery of the pavilion 12. Each of the lower girdle facets 25 includes a first side, a second side and a substantially curved side forming part of the circumference of the girdle 13. Each of the lower girdle facets 25 is aligned between two adjacent pavilion main facets 23. In one embodiment of the invention, each of the lower girdle facets 25 is aligned between two adjacent pavilion main facets 23 such that the first side of the lower girdle facet forms a common edge F with a side of the second portion of a first pavilion main facet and the second side of the lower girdle facet forms a common edge F' with a side of the second portion of a second pavilion main facet that is positioned adjacent to the first pavilion main facet.

In another embodiment of the invention, the point which the pavilion main facets 23 extend from includes a culet 26 (as shown in FIG. 1). This culet can be a point or a planar surface forming an additional facet.

In yet another embodiment of the invention, the girdle 13 includes a plurality of facets. Preferably, four to five facets are formed on each of the lower girdle facets 25.

Preferably, the gemstone 10 of the present invention has a table size between 54.0% and 56.0% of the total girdle diameter. The girdle 13 preferably has a thickness between 2.0% to 4.0% of the total girdle diameter and the pavilion 12 preferably has a depth of about 43.3% of the total girdle diameter. Preferably, the pavilion 12 has an angle of about 40.9° relative to the plane parallel to the horizontal plane of the girdle 13.

The gemstone 10 of the present invention is cut symmetrically with an 8-fold symmetry and has a total of 73 facets. In another embodiment of the invention, the gemstone 10 has a total of 74 facets, including the culet 26.

The present invention uses unique combination of angles and faceting to create a gemstone with enhanced characteristics of brilliance, scintillation and dispersion over a conventional round brilliant cut diamond. The unique combination of the crown and pavilion angles gives the gemstone of the present invention greater brilliance in and surrounding the gemstone. The unique number and arrangement of the facets at the crown and the pavilion give the gemstone greater scintillation as compared to a conventional round brilliant cut diamond. In particular, the use of the different angles and the unique arrangement and faceting of the gemstone create a gemstone that is capable of achieving a relatively high light performance.

Figure 4:
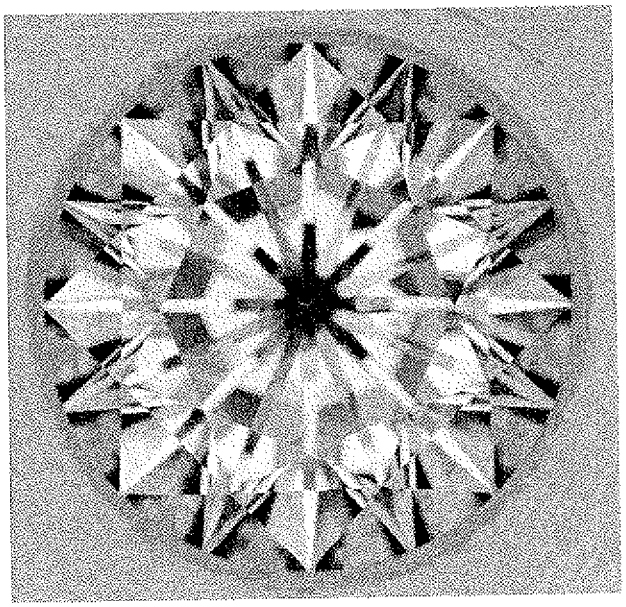
FIG. 4 is a plan view showing the effect achieved by the unique cut of the gemstone of the present invention when viewed in a table up position under a magnifying device.
Figure 5:
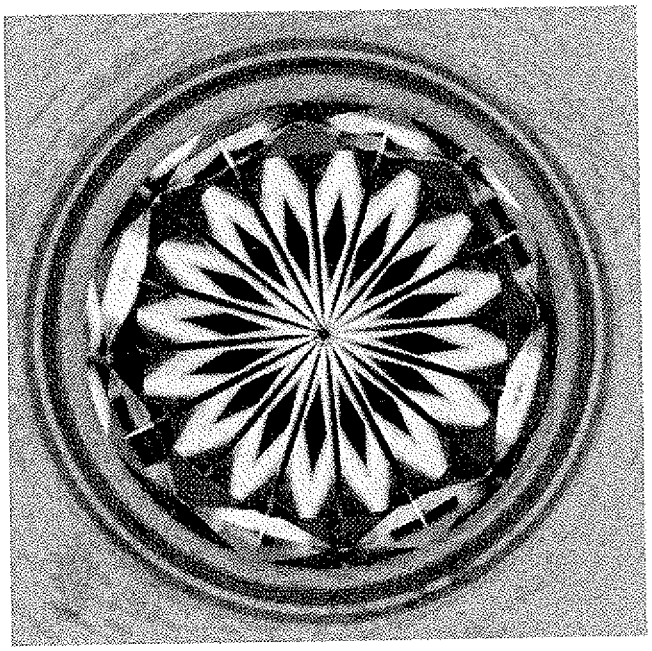
FIG. 5 is a plan view showing the effect achieved by the unique cut of the gemstone of the present invention when viewed down through the pavilion of the gemstone under a magnifying device.

It should also be noted that the unique combination of the angles and faceting used in the present invention is able to yield unique visual patterns as depicted in FIGS. 4 and 5 when the gemstone is viewed under a magnifying device. When the gemstone 10 of the present invention is viewed in a face-up direction (table up position) under a magnifying device, a pattern as depicted in FIG. 4 is observed. When the gemstone 10 of the present invention is viewed in a face-down direction (viewed through the pavilion) under a magnifying device, another pattern as depicted in FIG. 5 is observed. The visual patterns depicted in FIGS. 4 and 5 are unique to the gemstone 10 of the present invention and can only be accomplished by a gemstone having 73 facets, or 74 facets including the culet, created by using the prescribed angles and faceting as described above.

In one embodiment of the invention, the gemstone 10 is a diamond. The gemstone 10 can be of any dimension, size or weight.

The present invention also contemplates methods for creating the embodiment of the gemstone 10 as described above.

According to one embodiment of the invention, a method of cutting a gemstone having a crown, a girdle and a pavilion is provided. The method comprises forming eight second half facets on the crown, forming eight first half facets adjacent to the second half facets, forming a table on the crown, forming eight star facets surrounding the table and aligning each of the star facets between two adjacent first half facets and forming sixteen upper girdle facets between the second half facets. Each of the upper girdle facets is provided adjacent to, and forming a common edge with another upper girdle facet to form a pair of upper girdle facets and each pair of the upper girdle facets is aligned between two adjacent second half facets.

The method further comprises forming sixteen pavilion main facets on the pavilion, each extending concentrically from a point of the pavilion distant from the girdle and forming sixteen lower girdle facets and aligning each of the lower girdle facets between two adjacent pavilion main facets.

In the method of the present invention, the eight first half facets and the eight second half facets are formed at different angles. Preferably, the eight first half facets are each formed at an angle between 32.0° and 35.0° relative to the plane parallel to the horizontal plane of the girdle 13.

In one embodiment of the method of the invention, the star facets and the first half facets are aligned such that they form an upper portion of the crown. The second half facets and the upper girdle facets are aligned such that they form a lower portion of the crown. The upper portion and the lower portion of the crown are inclined at different angles. Preferably, the upper portion of the crown is inclined at an angle smaller than that of the lower portion of the crown.

The method also includes forming the star facets at an angle between 19.0° and 22.0° and forming the upper girdle facets at an angle between 40.0° and 43.0°, relative to the plane parallel to the horizontal plane of the girdle.

The method of the present invention combines the skills of highly skilled gemstone cutters and technology to create a unique gemstone with enhanced characteristics of brilliance, scintillation and dispersion over the prior art.

It should be noted that the sequence of forming the gemstone of the present invention is irrelevant, so long as the resulting gemstone has the arrangement of facets as described above.

The foregoing describes the invention including preferred forms thereof. Alterations and modifications as will be obvious to those skilled in the art are intended to be incorporated within the scope hereof as defined by the accompanying claims.

The invention claimed is:

1. A gemstone, comprising:

a girdle;

a crown extending in a first direction from the girdle, the crown consisting of:

a table, eight star facets surrounding the table, eight first half facets aligned between the star facets, eight second half facets provided adjacent to the first half facets, and sixteen upper girdle facets with each of the upper girdle facets provided adjacent to, and forms a common edge with another upper girdle facet to form a pair of upper girdle facets, each pair of the upper girdle facets is aligned between two adjacent second half facets, wherein the eight first half facets are each formed at an angle between 32.0° and 35.0° relative to a plane parallel to a horizontal plane of the girdle and the eight second half facets are each formed at an angle between 35.0° and 38.0° relative to the plane parallel to the horizontal plane of the girdle; and a pavilion extending from the girdle in a second direction opposite the first direction, the pavilion consisting of:

sixteen pavilion main facets extending concentrically from a point of the pavilion distant from the girdle, and sixteen lower girdle facets aligned between the pavilion main facets.

2. The gemstone according to claim 1, wherein the star facets and the first half facets form a first portion of the crown and the second half facets and the upper girdle facets form a second portion of the crown.

3. The gemstone according to claim 2, wherein the first portion of the crown is inclined at an angle smaller than that of the second portion of the crown.

4. The gemstone according to claim 1, wherein the star facets are formed at an angle between 19.0° and 22.0° relative to the plane parallel to the horizontal plane of the girdle and the upper girdle facets are formed at an angle between 40.0° and 43.0° relative to the plane parallel to the horizontal plane of the girdle.

5. The gemstone according to claim 1, wherein the girdle has a thickness of 2% to 4% of total girdle diameter.

6. The gemstone according to claim 1, wherein the pavilion has a depth of 43.3% of total girdle diameter and an angle of 40.9° relative to a plane parallel to horizontal plane of the girdle.

7. A method of cutting a gemstone having a crown, a girdle, and a pavilion, the method consisting of:

forming eight second half facets on the crown;

forming eight first half facets adjacent to the second half facets;

forming a table on the crown;

forming eight star facets surrounding the table and aligning each of the star facets between two adjacent first half facets;

forming sixteen upper girdle facets, each of the upper girdle facets provided adjacent to, and forming a common edge with another upper girdle facet to form a pair of upper girdle facets and aligning each pair of the upper girdle facets between two adjacent second half facets;

forming sixteen pavilion main facets on the pavilion, each of the pavilion main facets extending concentrically from a point of the pavilion distant from the girdle; and forming sixteen lower girdle facets and aligning each of the lower girdle facets between two adjacent pavilion main facets, wherein the eight first half facets are each formed at an angle between 32.0° and 35.0° relative to a plane parallel to a horizontal plane of the girdle and the eight second half facets are each formed at an angle between 35.0° and 38.0° relative to the plane parallel to the horizontal plane of the girdle.

8. The method according to claim 7, wherein the star facets and the first half facets form a first portion of the crown and the second half facets and the upper girdle facets form a second portion of the crown.

9. The method according to claim 8, wherein the first portion of the crown is inclined at an angle smaller than that of the second portion of the crown.

10. The method according to claim 7, further consisting of forming the star facets at an angle between 19.0° and 22.0° relative to the plane parallel to the horizontal plane of the girdle and forming the upper girdle facets at an angle between 40.0° and 43.0° relative to the plane parallel to the horizontal plane of the girdle.

* * * * *